US011148906B2

(12) United States Patent
Lovett

(10) Patent No.: US 11,148,906 B2
(45) Date of Patent: Oct. 19, 2021

(54) ELEVATOR VANDALISM MONITORING SYSTEM

(71) Applicant: Otis Elevator Company, Farmington, CT (US)

(72) Inventor: Teems E. Lovett, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 735 days.

(21) Appl. No.: 16/027,878

(22) Filed: Jul. 5, 2018

(65) Prior Publication Data

US 2019/0010018 A1 Jan. 10, 2019

Related U.S. Application Data

(60) Provisional application No. 62/529,834, filed on Jul. 7, 2017.

(51) Int. Cl.
*B66B 5/00* (2006.01)

(52) U.S. Cl.
CPC ..... *B66B 5/0006* (2013.01); *B66B 5/0012* (2013.01)

(58) Field of Classification Search
CPC ..... B66B 3/002; B66B 2201/463; B66B 5/00; B66B 5/0018; B66B 5/0012
See application file for complete search history.

(56) References Cited

U.S. PATENT DOCUMENTS 4,023,139 A 5/1977 Samburg
4,936,419 A 6/1990 Stadler et al.
5,445,245 A 8/1995 Ketoviita
5,569,888 A * 10/1996 Kamani ..... B66B 13/26 187/317
6,150,927 A * 11/2000 Nesbitt ..... B60R 25/1004 340/426.25

(Continued)

FOREIGN PATENT DOCUMENTS

CN 1780780 A 5/2006
CN 101665203 A 3/2010

(Continued)

OTHER PUBLICATIONS

Dekra Solutions: Remote Monitoring for Elevators, Press Release; wwww.DEKRA.de; Date Retrieved: Jul. 5, 2018; 3 Pages.

(Continued)

*Primary Examiner* — Marlon T Fletcher
(74) *Attorney, Agent, or Firm* — Cantor Colburn LLP

(57) ABSTRACT

An elevator vandalism monitoring system is configured to determine if an act of vandalism upon a component of an elevator system has occurred. The vandalism monitoring system includes a sensor, a processor, an electronic storage medium, a model, and a comparison module. The sensor is configured to monitor a detectable parameter associated with the component, and output a detectable parameter signal. The processor is configured to receive the detectable parameter signal. The model is stored in the electronic storage medium, and is associated with an expected parameter. The comparison module is executed by the processor, and is configured to generally compare the model to the detectable parameter signal for determining if a parameter anomaly exists.

18 Claims, 6 Drawing Sheets

(56) References Cited

U.S. PATENT DOCUMENTS

| | | | | |
|---|---|---|---|---|
| 6,615,175 | B1 * | 9/2003 | Gazdzinski | B66B 1/34 187/396 |
| 6,854,565 | B2 * | 2/2005 | Perala | B66B 5/0006 187/247 |
| 6,970,183 | B1 * | 11/2005 | Monroe | G08B 7/062 348/143 |
| 7,073,633 | B2 * | 7/2006 | Weinberger | B66B 5/0025 187/393 |
| 7,721,852 | B2 * | 5/2010 | Ishioka | B66B 7/08 187/391 |
| 7,823,706 | B2 * | 11/2010 | Tyni | B66B 5/0031 187/393 |
| 7,857,105 | B2 * | 12/2010 | Roydhouse | B66B 1/34 187/391 |
| 7,909,144 | B2 | 3/2011 | Fukui et al. | |
| 8,540,057 | B2 | 9/2013 | Schuster et al. | |
| 9,469,503 | B2 * | 10/2016 | Bunter | B66B 13/143 |
| 2003/0192746 | A1 | 10/2003 | Suzuki | |
| 2008/0230326 | A1 * | 9/2008 | Tyni | B66B 5/0031 187/393 |
| 2010/0140023 | A1 | 6/2010 | Fukui et al. | |
| 2014/0058700 | A1 | 2/2014 | Gehrke | |
| 2015/0284214 | A1 | 10/2015 | Park et al. | |
| 2015/0314991 | A1 | 11/2015 | Trottman | |
| 2015/0353322 | A1 * | 12/2015 | Roivainen | G01H 3/00 73/579 |
| 2019/0010018 | A1 * | 1/2019 | Lovett | B66B 5/0006 |
| 2019/0010022 | A1 * | 1/2019 | Trcka | G05B 13/0265 |
| 2020/0223660 | A1 * | 7/2020 | Kinnari | B66B 3/002 |

FOREIGN PATENT DOCUMENTS

| | | | |
|---|---|---|---|
| CN | 101801831 | A | 8/2010 |
| EP | 2824056 | A1 | 1/2015 |
| JP | 04055275 | H | 2/1992 |
| JP | H0733350 | A | 2/1995 |
| JP | 2000128452 | A | 5/2000 |
| JP | 2014073893 | A | 4/2014 |
| JP | 2015037994 | A | 2/2015 |

OTHER PUBLICATIONS

Integrated Security System; MS Systems Software Sdn. Bhd.; 2003; Date Retrieved: Jul. 5, 2018; 20 Pages.

KONE E-Link; Elevator and Escalator Monitoring and Command System; Date Retrieved: Jul. 5, 2018; 8 Pages.

Search Report for European Application No. 18182218.0 dated Dec. 7, 2018; 8 pages.

* cited by examiner

ELEVATOR VANDALISM MONITORING SYSTEM

CROSS REFERENCE TO RELATED APPLICATIONS

This application claims the benefit of U.S. Provisional Application No. 62/529,834, filed Jul. 7, 2017, which is incorporated by reference in its entirety herein.

BACKGROUND

The present disclosure relates to an elevator system, and more particularly, to an elevator vandalism monitoring system.

Elevator systems may include multiple cars operating in multiple hoistways. Each hoistway may be associated with multiple gates operating on multiple floors of a building. In general, the vast array of elevator components may make maintenance activity and component monitoring time consuming and cumbersome. Yet further, vandalism and elevator misuse may contribute toward maintenance and/or repair activity.

SUMMARY

An elevator vandalism monitoring system for determining an act of vandalism upon a component of an elevator system according to one, non-limiting, embodiment of the present disclosure includes a sensor configured to monitor a detectable parameter associated with the component, and output a detectable parameter signal; and a processor configured to receive the detectable parameter signal; an electronic storage medium; a model stored in the electronic storage medium and associated with an expected parameter; and a vandalism comparison module executed by the processor, and configured to generally compare the model to the detectable parameter signal for determining if a parameter anomaly exists.

Additionally to the foregoing embodiment, the vandalism comparison module applies a vandalism threshold to determine the existence of the parameter anomaly which is associated with the act of vandalism.

In the alternative or additionally thereto, in the foregoing embodiment, the elevator vandalism monitoring system includes an application loaded into a mobile device, and configured to receive a vandalism signal from the processor for notifying a user of the mobile device of the act of vandalism.

In the alternative or additionally thereto, in the foregoing embodiment, the mobile device is a smartphone.

In the alternative or additionally thereto, in the foregoing embodiment, the sensor is an accelerometer.

In the alternative or additionally thereto, in the foregoing embodiment, the detectable parameter is vibration and the component is an elevator door.

In the alternative or additionally thereto, in the foregoing embodiment, the sensor is an imaging device.

In the alternative or additionally thereto, in the foregoing embodiment, the component is a call panel.

In the alternative or additionally thereto, in the foregoing embodiment, the model is determined by an elevator health monitoring system.

An elevator system according to another, non-limiting, embodiment includes a component; a sensor configured to monitor a detectable parameter associated with the component and output a detectable parameter signal; at least one processor configured to receive the detectable parameter signal; at least one electronic storage medium; and an elevator vandalism monitoring system including: a model stored in the electronic storage medium, and associated with expected feature values associated with the component as a function of time, and a vandalism comparison module executed by the at least one processor, stored in the at least one electronic storage medium, and configured to generally compare the model to actual feature values extracted from the detectable parameter signal for determining if a feature anomaly exists.

Additionally to the foregoing embodiment, the elevator system includes a health monitoring system configured to be at least in-part executed by the at least one processor, receive the parameter signal, extract the actual feature values from the parameter signal, and apply machine learning to determine a degradation level associated with the actual feature to develop the model.

In the alternative or additionally thereto, in the foregoing embodiment, the health monitoring system includes a feature generation module stored in one of the at least one electronic storage medium and executed by one of the at least one processor for extracting the actual feature values from the parameter signal.

In the alternative or additionally thereto, in the foregoing embodiment, the health monitoring system includes a fault detection module stored in one of the at least one electronic storage medium and executed by one of the at least one processor for analyzing the actual feature values and extracting feature derivations from the actual feature values indicative of changes in normal component operation.

In the alternative or additionally thereto, in the foregoing embodiment, the health monitoring system includes a fault classification module stored in one of the at least one electronic storage medium and executed by one of the at least one processor to classify the feature derivations into respective component faults.

In the alternative or additionally thereto, in the foregoing embodiment, the health monitoring system includes a degradation estimation module stored in one of the at least one electronic storage medium, executed by one of the at least one processor, and configured to apply machine learning to develop the model.

In the alternative or additionally thereto, in the foregoing embodiment, the feature anomaly is in excess of the degradation level.

In the alternative or additionally thereto, in the foregoing embodiment, the component is an elevator door.

In the alternative or additionally thereto, in the foregoing embodiment, the sensor is an accelerometer.

In the alternative or additionally thereto, in the foregoing embodiment, the sensor is an imaging device.

In the alternative or additionally thereto, in the foregoing embodiment, the elevator system includes a camera configured to record upon determination of the feature anomaly to confirm an act of vandalism.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
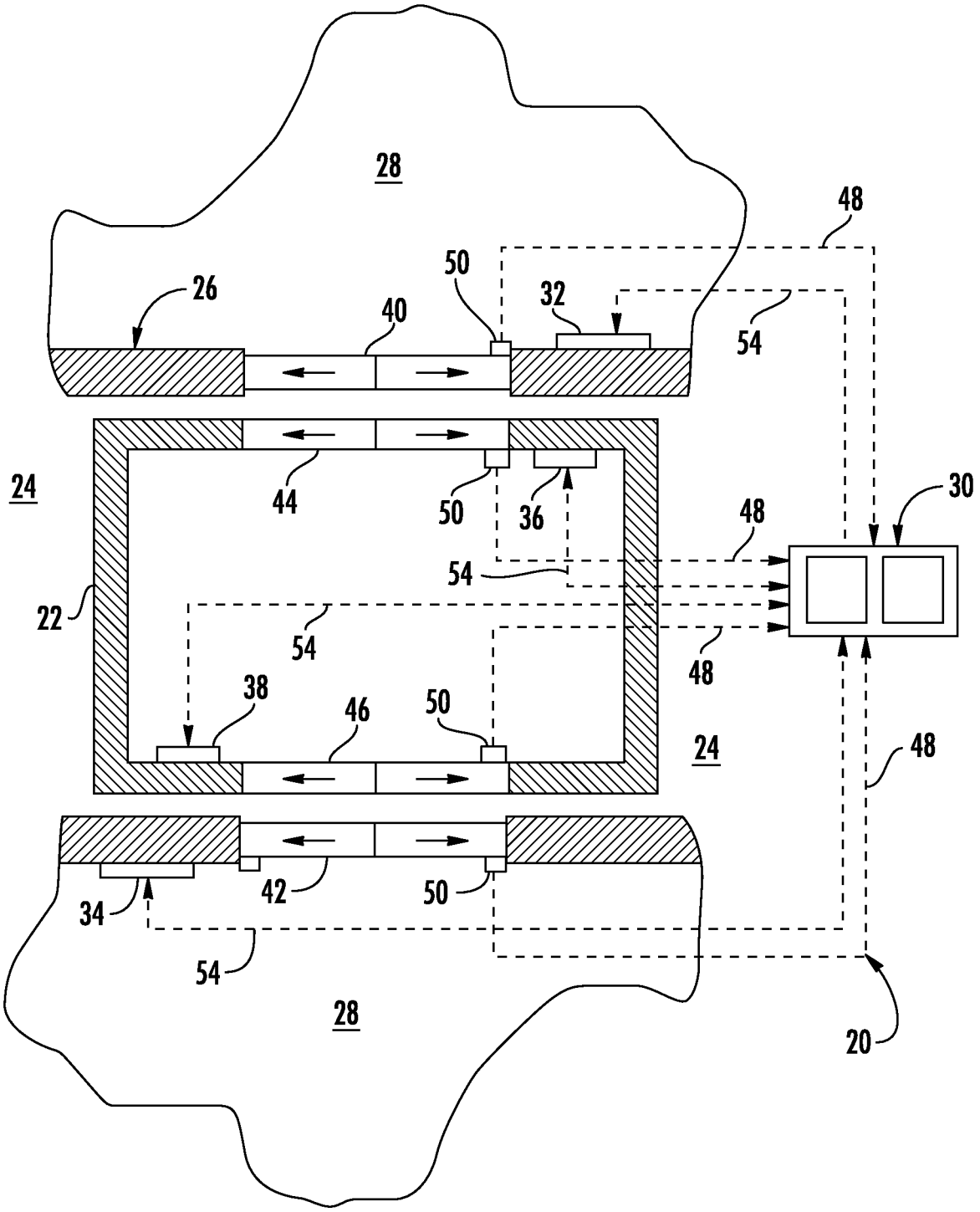
FIG. 1 is a schematic of an elevator system in an exemplary embodiment of the present disclosure.

Referring to FIG. 1, an exemplary embodiment of an elevator system 20 is illustrated. The elevator system 20 may include an elevator car 22 adapted to move within a hoistway 24 having boundaries defined by a structure or building 26, and between a multitude of floors or landings 28 of the building 26. The elevator system 20 may further include a control configuration 30 and a multitude of operating and/or moving components that may require maintenance and/or repair, and may be generally monitored and/or controlled by the control configuration 30. The components may include a plurality of call panels (four illustrated as 32, 34, 36, 38), at least one gate or landing door (i.e., two illustrated as 40, 42), at least one car door (i.e. two illustrated as 44, 46), and other components. The elevator car 22 is propelled by a component (i.e., propulsion system, not shown) that may be controlled by the control configuration 30 of the elevator system 20. Examples of a propulsion system may include self-propelled or ropeless (e.g., magnetic linear propulsion), roped, hydraulic, and other propulsion systems. It is further contemplated and understood that the hoistway 24 may extend, and thus the car 22 may travel, in a vertical direction, a horizontal direction, and/or a combination of both.

The landing doors 40, 42 may be located at opposite sides of the hoistway 24. In one example, the doors 40, 42 may be located on some floors 28 and only one of the doors 40, 42 may be located on other floors 28. The car doors 44, 46 may be respectively located on opposite sides of the elevator car 22. Car door 44 may be associated with landing door 40, and car door 46 may be associated with landing door 42. When a passenger enters and exits the elevator car 22 at a specific floor 28, door pairs 40, 44, or door pair 42, 46 must be open. Before the elevator car 22 begins to travel, all doors 40, 42, 44, 46 must be closed. The control configuration 30 may monitor and control all of these events. It is contemplated and understood that a single elevator car 22 may be associated with a single set of doors, three sets of doors, or more.

The landing doors 40, 42 may be located at each landing 28, which barriers the otherwise exposed hoistway 24 for the protection of waiting passengers yet to board the elevator car 22. The doors 44, 46 of the elevator car 22 protect the passengers within the elevator car 22 while the car is moving within the hoistway 24. The monitoring and actuation of all doors 40, 42, 44, 46 may be controlled by the control configuration 30 via, for example, electrical signals (see arrows 48) received from a plurality of sensors 50 (e.g., motion and/or position sensors) with at least one sensor 50 positioned at each door 40, 42, 44, 46. The sensors 50 may be motion and/or position sensors, and may further be an integral part of door actuator assemblies 52 (see FIG. 3) that at least facilitate door opening and closing functions.

Figure 2:
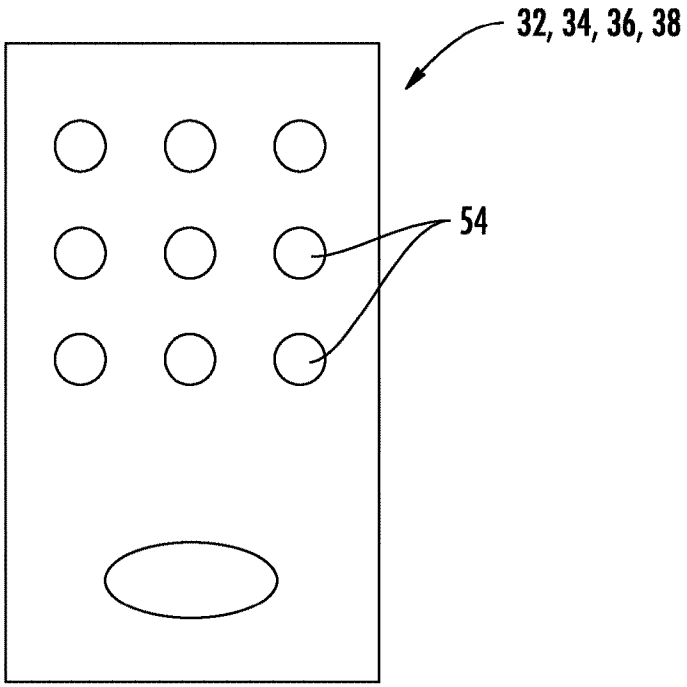
FIG. 2 is a front view of a call panel of the elevator system.

Referring to FIGS. 1 and 2, the call panels 32, 34, 36, 38 may be configured for two-way communication via electric signals (see arrows 54) with the control configuration 30. In one example, the call panels 32, 34 may be landing call panels located adjacent to respective landing doors 40, 42 on each floor 28. That is, each landing call panel 32, 34 may be mounted to a wall of the building 26. The call panels 36, 38 may be car call panels located inside the elevator car 22 and, in one example, adjacent to respective car doors 44, 46. Any one or more of the call panels 32, 34, 36, 38 may be an interactive touch screen with the images of each call selection 54 (i.e., interactive floor or area destination selections) displayed on the screen and configured to visually change when selected. Alternatively, any one or more call panels 32, 34, 36, 38 may include mechanical buttons that may be configured to, for example, illuminate when selected. In one alternative embodiment, the elevator system 20 may include landing call panels 32, 34 that provide a selection of desired car travel direction (e.g., up and down directions represented by arrow) and the car call panels 36, 38 may provide, or include, the actual call selection 54 relative to a desired floor destination. It is contemplated and understood that many other configurations and locations of the call panels 32, 34, 36, 38 may be applicable to the present disclosure. It is contemplated and understood that the call panels 32, 34, 36, 38 may include a host of other capabilities and may be programmable and/or may include a processor that may be part of the control configuration 30.

Figure 3:
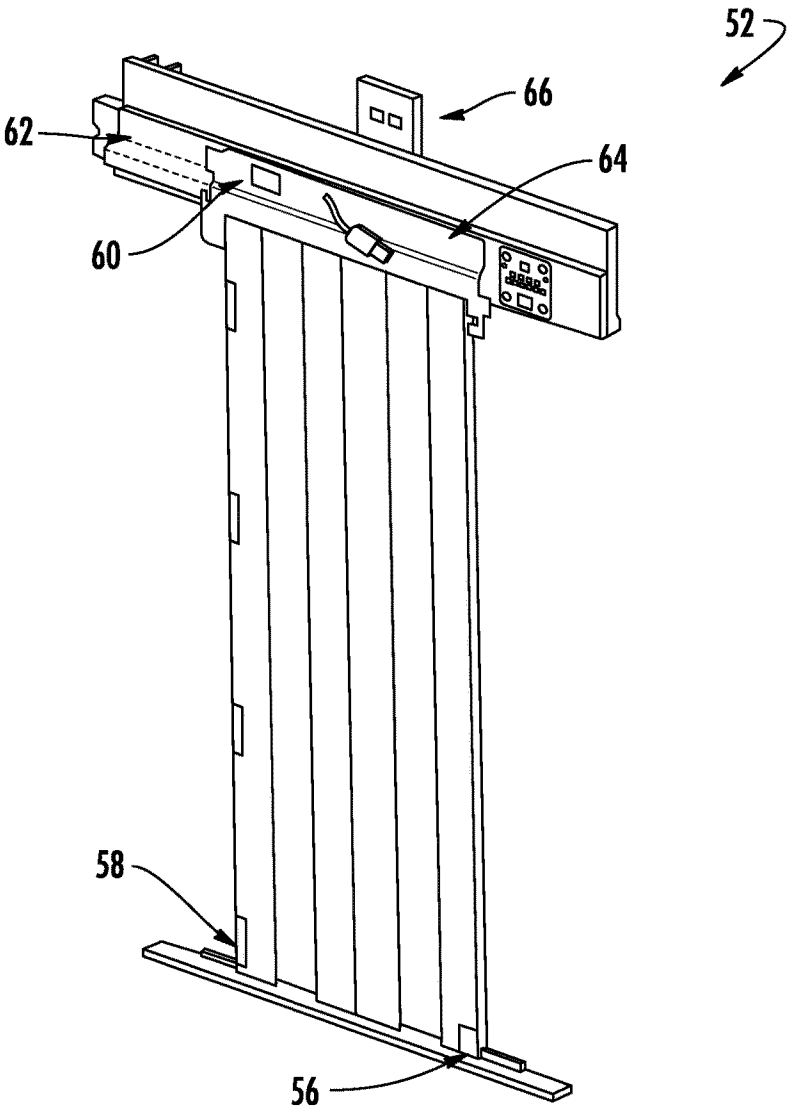
FIG. 3 is a perspective view of a door actuator assembly of the elevator system.

Referring to FIG. 3, the door actuator assemblies 52 of the elevator system 20 may generally include components such as a lower sill 56, a gib 58, a roller 60, a belt 62, an upper track 64, and a door operator 66 that may include an electric motor or may be hydraulically actuated. The components of the door actuator assembly 52 are generally known by one skilled in the art, thus further explanation of physical arrangements and interactions will not be described herein. Moreover, any desired door actuator assembly 52 and components and arrangements thereof may be used. The door operator 66 is configured to receive a command signal (see arrow 58) from the control configuration 30, which may be based, at least in-part, on processing of the sensor signal 48.

Figure 4:
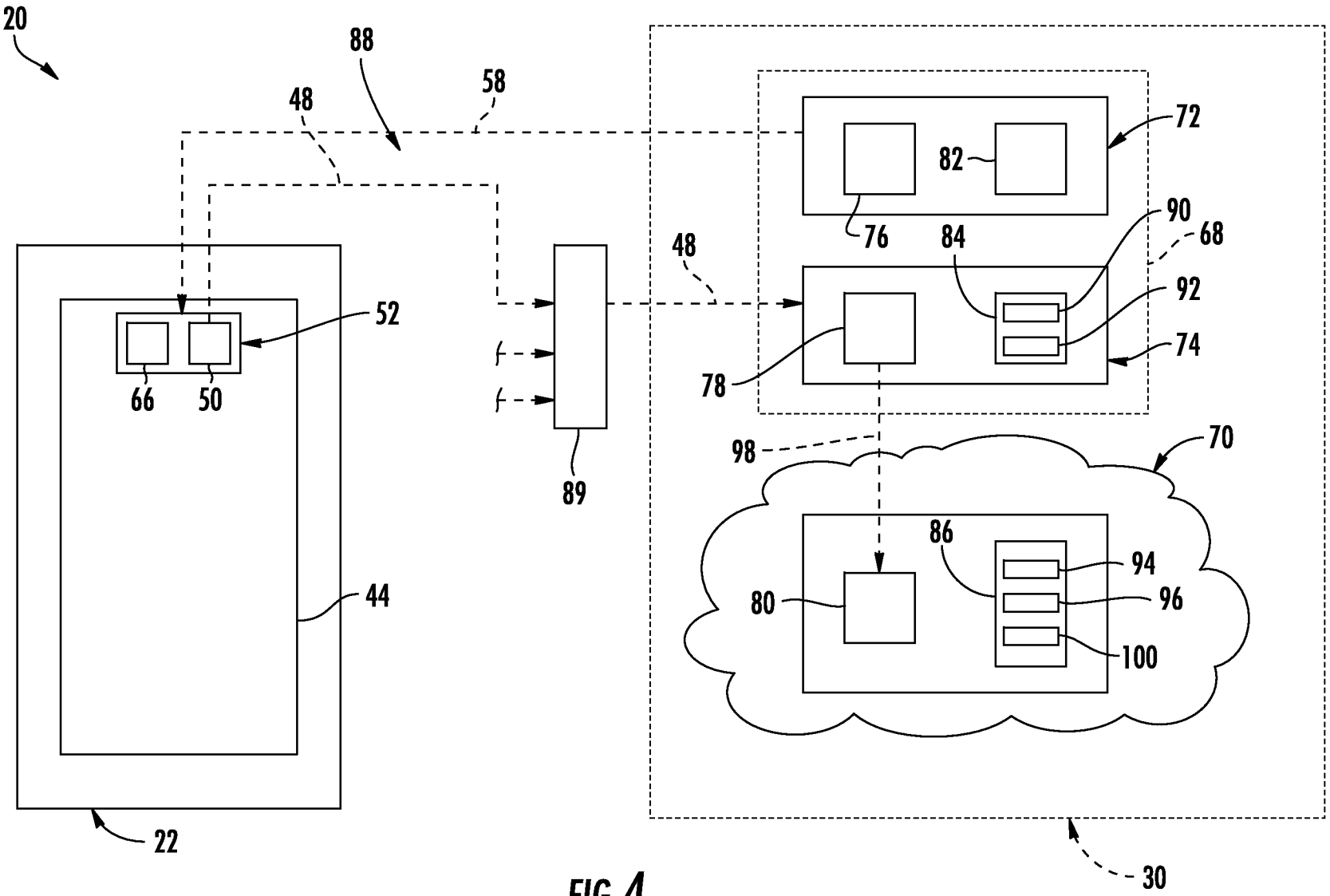
FIG. 4 is a schematic of the elevator system further illustrating a health monitoring system of the elevator system.

Referring to FIG. 4, the control configuration 30 may include a local control arrangement 68, and optionally a controller and/or server 70 that may be remote and cloud-based. The local control arrangement 68 may include at least one controller (i.e., two illustrated as 72, 74. The server 70 and the local controllers 72, 74 may each generally include respective processors 76, 78, 80 and respective electronic storage mediums 82, 84, 86 that may be computer writeable and readable. The first local controller 72 may be configured to generally monitor and control normal operations and functions of the elevator system via receipt of a multitude of sensory inputs (e.g., signal 48) and a multitude of output commands. It is contemplated and understood that the controller 70 may not generally be remote, and instead, may be at least in-part mobile. For example, the controller 70 may include a mobile smart device (e.g., smartphone) that may be carried by a person (e.g., a service technician). In one embodiment, the remote server 70 may be local.

The second local controller 74 and the remote server 70 may be part of a health monitoring system 88 along with, for example, a sensor hub or gateway 89, and the sensor 50 and/or any variety of sensors that may be otherwise dedicated to the health monitoring system. The health monitoring system 88 may be configured to collect data from one or more sensory inputs, via the gateway 89, and during relevant component operations (e.g., car door 44 operations), and process the sensory input data to assess, for example, door health and degradation of various door components. Other sensory inputs may include signals from accelerometer sensors, microphones, image devices, and others. The health monitoring system 88 may also be configured to determine door motion through the existing elevator communication system(s) or additional sensor inputs.

In general, the health monitoring system 88 may be configured to process data in two phases. The first phase may extract relevant features from sensory data, and aggregate and compress the signal. The second phase may apply machine learning to determine degradation level of individual components (e.g., door components). The first phase may be done locally (i.e., on site), and the second phase may be done either remotely (i.e., in the cloud), or locally (e.g., on a service technician's smartphone).

The health monitoring system 88 may further include a feature generation module 90, a fault detection module 92, a fault classification module 94 and a degradation estimation module 96. The modules 90, 92, 94, 96 may be software based, and may be part of a computer software product. In one embodiment, the feature generation module 90 and the fault detection module 92 may be stored locally in the electronic storage medium 94 of the local controller 74 or local control arrangement 68, and executed by the processor 78. In the same embodiment, the fault classification module 94 and the degradation estimation module 96 may be stored in the electronic storage medium 86 of the server 70 and executed by the processor 80.

The feature generation module 90 is configured to extract a predesignated feature from a parameter signal (i.e., signal 48) and from at least one sensor 50. In one example, the sensor 50 may be adapted to at least assist in controlling and/or monitoring door motion as the parameter and generally detect vibration (i.e., amplitude and frequency) as the feature. That is, the feature generation module 90 receives relevant properties of raw signals and applies data reduction techniques producing processed data sent to the fault detection module 92. It is contemplated and understood that the sensor 50 may be dedicated to detect vibration (e.g., an accelerometer) for use by the feature generation module 90. Other examples of a sensor 50 may include a microphone, a velocity sensor, a position sensor, and a current sensor. The microphone may be applied to detect unusual sounds. The velocity sensor may be applied to detect unexpected high or low velocities, the position sensor may be applied to detect an unusual or unexpected position of a component in a given moment in time. The current sensor may be applied to detect unexpected current levels in, for example, an electric motor of the door operator 66.

The fault detection module 92 receives the processed data from the feature generation module 90, analyzes the predesignated feature (e.g., vibration), and extracts feature derivations from the predesignated feature that may be indicative of abnormal operation (e.g., door operation). Such abnormal door operation may be caused by any number of issues including debris in the sill 56, degradation of the rollers 60, tension issues of the belt 62, and others. The processed data associated with the feature derivations may then be sent over a wireless pathway 98 to the cloud-based server 70 for further processing by the fault classification module 94. In one embodiment, the wireless pathway 98 may be wired.

The fault classification module 94 receives the feature derivation data from the fault detection module 92, and classifies the feature derivations into multiple faults. For example, the feature derivation data may contain trait frequencies at trait amplitudes each indicative of a particular fault. One vibration trait characteristic may point toward issues with the sill 56, and another toward issues with the track 64, and yet another toward issues with the belt 62. The processed data associated with the classified feature derivations may then be sent to the degradation estimation module 96.

Figure 5:
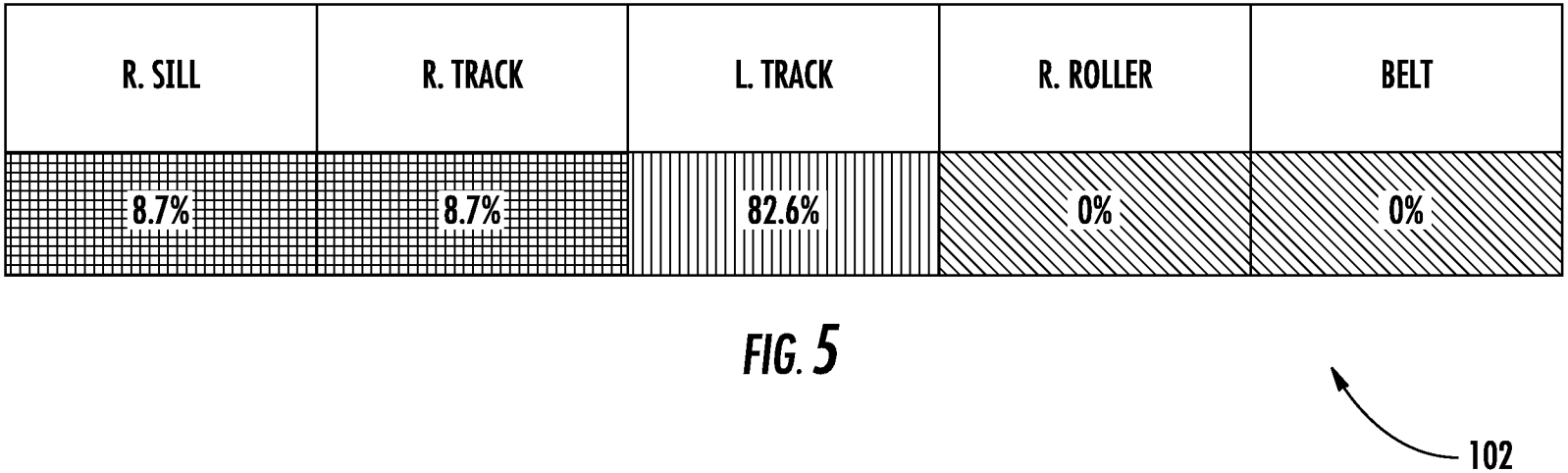
FIG. 5 is a degradation level table produced by the health monitoring system.

Referring to FIGS. 4 and 5, the degradation estimation module 96 may be configured to apply a model 100 stored in the storage medium 86 of the server 70 to the classified feature derivation data to determine where the associated component lies along a degradation model or line. That is, by applying the model 100 the expected remaining life of a component (e.g., door component) and/or the severity of the need for maintenance may be determined. The degradation estimation module 96 may apply machine learning (i.e., algorithms) and/or may include a temporal regression feature, to enhance accuracy of the model 100.

Referring to FIG. 5, one example of a table 102 representing the degradation level of various exemplary components is illustrated. The table 102 may generally be produced by the degradation estimation module 96 utilizing the model 100, and may be sent to any variety of destinations. In one embodiment, a service technician, building owner, service center, or other interested party may receive the table 102. In the present example, the table 102 informs the technician that a right sill has degraded by 8.7%, a right track has degraded by 8.7%, a left track has degraded by 82.6% and requires maintenance, a right roller has not degraded, and a belt has not degraded.

In another embodiment, the modules 90, 92 may be executed by the local controller 74, the modules 94, 96 may be loaded into and executed by a smartphone that may be carried by a service technician, and the model 100 may be stored in a cloud-based server 70 and retrieved by the smartphone.

Figure 6:
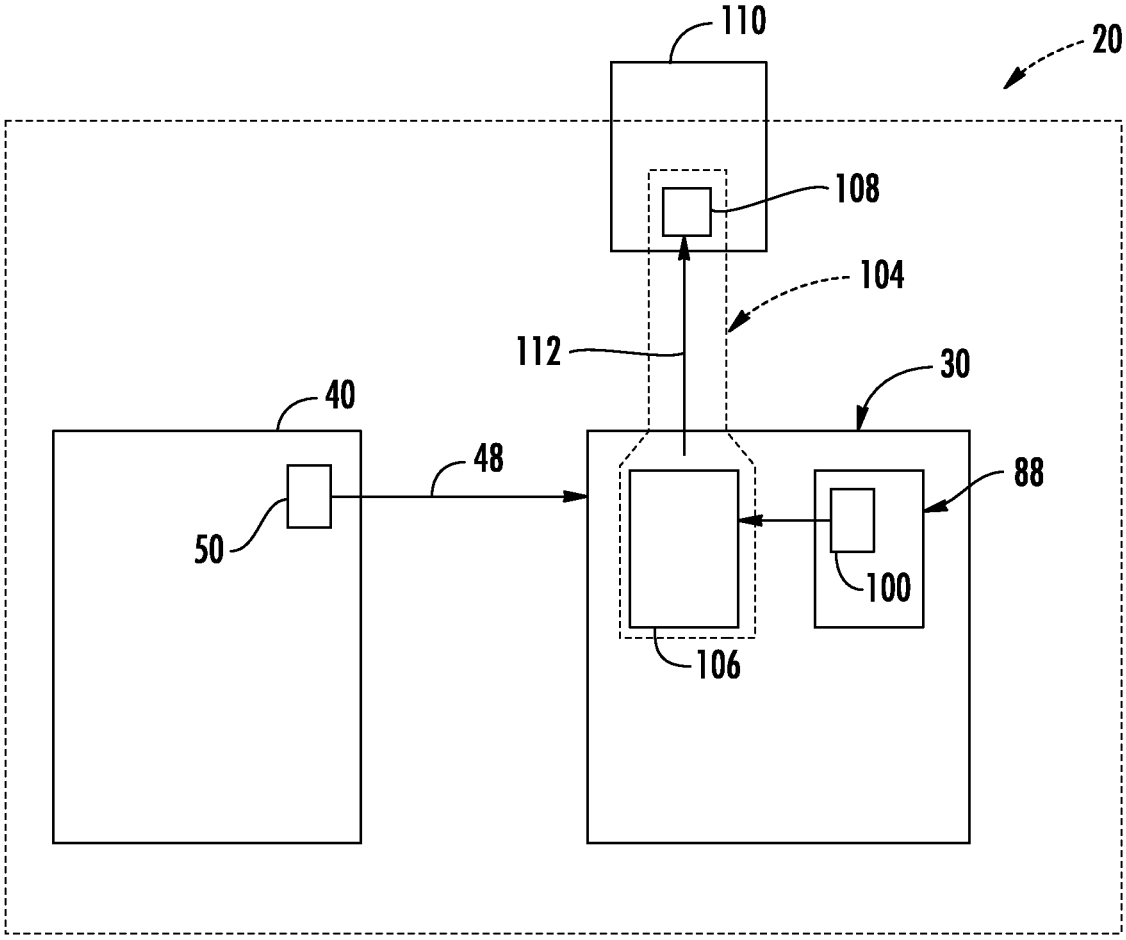
FIG. 6 is a schematic of a second embodiment of an elevator system that includes a vandalism monitoring system.

Referring to FIG. 6, another embodiment of the elevator system 20 is illustrated, and may include the component 40 (e.g., elevator door), the sensor 50, the control configuration 30, the health monitoring system 88, and an elevator vandalism monitoring system 104. The health monitoring system 88 in this embodiment is generally illustrated as a computer software product configured to be executed by one or more processors of the control configuration 30 as previously described, and that utilizes various components and associated signals (e.g., signal 48) of the elevator system 20.

The elevator vandalism monitoring system 104 may generally operate in real-time to detect acts of vandalism upon various components of the elevator system 20. For example, the vandalism monitoring system 104 may be configured to detect vandalism upon any one or more of the doors 40, 42, 44, 46, any one or more of the call panels 32, 34, 36, 38, and any other component. The signal 48 outputted by the sensor 50 may generally be shared by the health monitoring system 88 and the elevator vandalism monitoring system 104 (i.e., as illustrated). Alternatively, the sensor 50 may be dedicated for use, solely, by the vandalism monitoring system 104. In one embodiment, the sensor 50 may be part of the vandalism monitoring system 104, and in another embodiment the vandalism monitoring system 104 may be software-based and configured to simply receive the sensor signal 48.

The vandalism monitoring system 104 may include a comparison module 106 and a mobile device application 108. The comparison module 106 may be computer software-based, and may be loaded and stored into one of the electronic storage mediums 84, 86 for execution by one of the respective processors 78, 80 (see FIG. 4) of the control configuration 30. The mobile device application 108 may also be software-based and may be loaded into a user interface device 110 that may be a mobile device having a processor and an electronic storage medium. Examples of a mobile device 110 include a tablet, a smartphone, and others. In one embodiment, the user interface may be any computing device connected to a network or cloud computer, such as a computer workstation or laptop. It is contemplated and understood that the comparison module 106 may be a form of a classification or anomaly detection module.

The vandalism monitoring system 104 may provide users or customers with real-time vandalism notifications (see arrow 112) via, for example, the mobile device 110. In one embodiment, the vandalism notification 112 may be a wireless vandalism signal. The vandalism notifications 112 may include data relative to the location of the act of vandalism. For example, the notification data may specify a specific elevator car 22, a specific elevator hoistway 24, and or a specific floor or landing.

In operation of the vandalism monitoring system 104, the sensor 50 is configured to monitor a detectable parameter associated with a component of the elevator system 20, and send the parameter signal 48 to the control configuration 30 as previously described. The health monitoring system 88 may utilize aspects of the parameter signal 48 to extract features, and/or feature values, from the parameter signal 48 as previously described. The features are then used to develop, and/or further refine, the degradation model 100.

The comparison module 106 of the vandalism monitoring system 104 may be configured to receive the sensor parameter signal 48 and generally compare the signal 48 to the model 100. In another embodiment, the health monitoring system 88 may communicate with the comparison module 106 by providing extracted feature values processed from the parameter signal 48. In this embodiment, the comparison module 106 may compare the extracted feature values to the expected feature values represented in the model 100. It is contemplated and understood that the term "compare" may include the process of classification. For example, the comparison module 106 may be configured to classify a detectable parameter signal anomaly as an act of vandalism or not.

Figure 7:
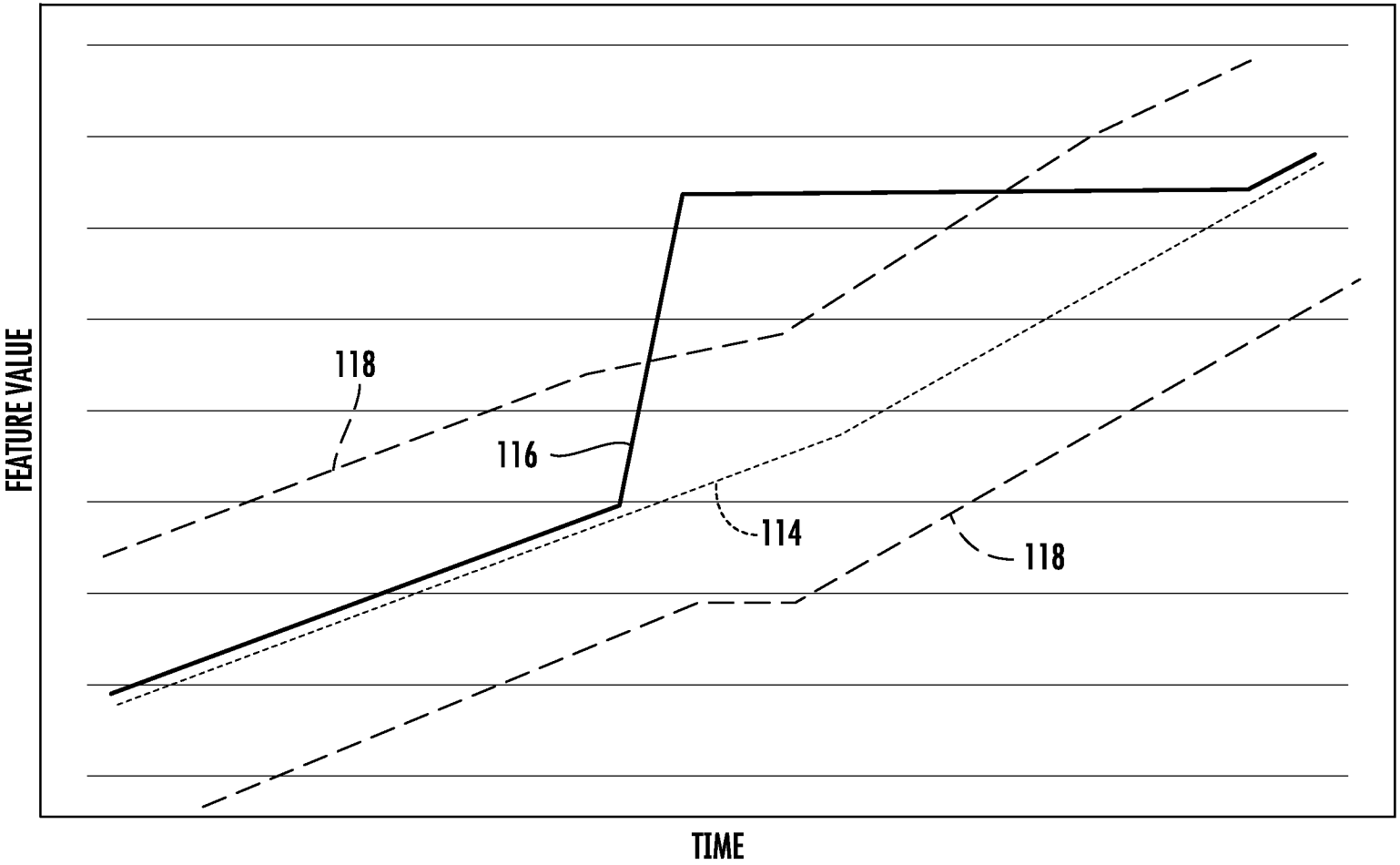
FIG. 7 is a graph depicting a degradation model developed and utilized by the elevator system.

Referring to FIG. 7, one example of the degradation model 100 is illustrated as a time verse expected feature value graph. The segmented line 114 represents the learned expected feature value as a function of time. The solid line 116 represents the measured, or actual, feature values as a function of time and extracted from the parameter signal(s) 48. The border lines 118 may generally represent threshold values as a function of time. It is contemplated and understood that the term "threshold" may include an actual threshold value or may simply be a "signal characteristic."

In operation, the comparison module 106 may generally compare the expected feature value 114 (i.e., line) to the actual feature value 116 that is associated with the detectable parameter signal 48. If the actual feature value 116 deviates outside of the threshold value 118, the comparison module 106 may determine that a parameter or feature anomaly exists, which may be indicative of an act of vandalism occurring in real-time. Upon this determination, the comparison module 106 may send a vandalism notification 112 (see FIG. 6) to the application 108 loaded in the mobile device 110. The application 108 may then communicate, via a user interface, that an on-going act of vandalism is occurring. This communication may include the location of the vandalism, and may further predict the type of vandalism and upon what component it is occurring. Such a prediction may be accomplished via machine learning applied by the vandalism monitoring system 104, or the health monitoring system 88.

In one embodiment, the vandalism monitoring system 88 may include a form of imaging confirmation of vandalism initiated by or when the comparison module 106 determines, or predicts, that vandalism is occurring. The camera may be the sensor 50, or may be another sensor. The camera may be located in the elevator car 22, in a lobby, or other location, and may be turned on upon a command by a user and/or the comparison module 106 to visually record an act of vandalism at the location. The image may be sent to the mobile device 110 to allow a user to identify whether vandalism is actually occurring. Moreover, the video may allow the user to identify the perpetrator of the vandalism and thereby notify authorities.

It is contemplated and understood that application of the health monitoring system 88 and the vandalism monitoring system 104 is not limited to elevator doors, but may include other elevator components such as brakes, drive motors, guide wheels, interior car walls, other structural components, and more. The type of sensor 50 may generally be dependent upon the elevator component being monitored.

The control configuration 30, or portions thereof, may be part of, one or more Application Specific Integrated Circuit(s) (ASIC), electronic circuit(s), central processing unit(s) (e.g., microprocessor and associated memory and storage) executing one or more software or firmware programs and routines, combinational logic circuit(s), input/output circuit(s) and devices, appropriate signal conditioning and buffer circuitry, and other components to provide the described functionality.

Software, modules, applications, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators and other devices The present disclosure may be a system, a method, and/or a computer program product. The computer program product may include a computer readable storage medium (or media) having computer readable program instructions thereon for causing a processor to carry out aspects of the present disclosure.

The computer readable storage medium(s) can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Advantages and benefits of the present disclosure include providing customers with a real-time notification of vandalism occurring to an elevator system, and/or elevator misuse. Other advantages include the ability to provide insurance companies, or the customer themselves, with reduced vandalism repair costs. Manufacturers of the elevator system may benefit from the vandalism monitoring system by providing the system as a subscription, thereby creating a revenue stream. In general, the knowledge that the vandalism monitoring system provides includes a distinction between normal wear and acts of vandalism that may impact warranty and repair costs.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator vandalism monitoring system for determining an act of vandalism upon a component of an elevator system, the elevator vandalism monitoring system comprising:

a sensor configured to monitor a detectable parameter associated with the component, and output a detectable parameter signal; and a processor configured to receive the detectable parameter signal;

an electronic storage medium;

a model stored in the electronic storage medium and associated with an expected parameter;

a vandalism comparison module executed by the processor, and configured to generally compare the model to the detectable parameter signal for determining if a parameter anomaly exists; and an application loaded into a mobile device, and configured to receive a vandalism signal from the processor for notifying a user of the mobile device of the act of vandalism.

2. The elevator vandalism monitoring system set forth in claim 1, wherein the vandalism comparison module applies a vandalism threshold to determine the existence of the parameter anomaly which is associated with the act of vandalism.

3. The elevator vandalism monitoring system set forth in claim 1, wherein the mobile device is a smartphone.

4. The elevator vandalism monitoring system set forth in claim 1, wherein the sensor is an accelerometer.

5. The elevator vandalism monitoring system set forth in claim 4, wherein the detectable parameter is vibration and the component is an elevator door.

6. The elevator vandalism monitoring system set forth in claim 1, wherein the sensor is an imaging device.

7. The elevator vandalism monitoring system set forth in claim 1, wherein the component is a call panel.

8. The elevator vandalism monitoring system set forth in claim 1, wherein the model is determined by an elevator health monitoring system.

9. An elevator system comprising:

a component;

a sensor configured to monitor a detectable parameter associated with the component and output a detectable parameter signal;

at least one processor configured to receive the detectable parameter signal;

at least one electronic storage medium; and an elevator vandalism monitoring system including:

a model stored in the electronic storage medium, and associated with expected feature values associated with the component as a function of time, a vandalism comparison module executed by the at least one processor, stored in the at least one electronic storage medium, and configured to generally compare the model to actual feature values extracted from the detectable parameter signal for determining if a feature anomaly exists, and a health monitoring system configured to be at least in-part executed by the at least one processor, receive the parameter signal, extract the actual feature values from the parameter signal, and apply machine learning to determine a degradation level associated with the actual feature to develop the model.

10. The elevator system set forth in claim 9, wherein the health monitoring system includes a feature generation module stored in one of the at least one electronic storage medium and executed by one of the at least one processor for extracting the actual feature values from the parameter signal.

11. The elevator system set forth in claim 10, wherein the health monitoring system includes a fault detection module stored in one of the at least one electronic storage medium and executed by one of the at least one processor for analyzing the actual feature values and extracting feature derivations from the actual feature values indicative of changes in normal component operation.

12. The elevator system set forth in claim 11, wherein the health monitoring system includes a fault classification module stored in one of the at least one electronic storage medium and executed by one of the at least one processor to classify the feature derivations into respective component faults.

13. The elevator system set forth in claim 12, wherein the health monitoring system includes a degradation estimation module stored in one of the at least one electronic storage medium, executed by one of the at least one processor, and configured to apply machine learning to develop the model.

14. The elevator system set forth in claim 9, wherein the feature anomaly is in excess of the degradation level.

15. The elevator system set forth in claim 9, wherein the component is an elevator door.

16. The elevator system set forth in claim 9, wherein the sensor is an accelerometer.

17. The elevator system set forth in claim 9, wherein the sensor is an imaging device.

18. The elevator system set forth in claim 9, further comprising:

a camera configured to record upon determination of the feature anomaly to confirm an act of vandalism.

* * * * *